United States Patent [19]

Schenström

[11] Patent Number: 4,672,693

[45] Date of Patent: Jun. 16, 1987

[54] SITTING BATHTUB

[76] Inventor: Inga-Lena Schenström, 6 Första Kyrkvägsgränd, Norrköping, Sweden, S-602 10

[21] Appl. No.: 776,041

[22] PCT Filed: Jan. 9, 1985

[86] PCT No.: PCT/SE85/00006

§ 371 Date: Sep. 10, 1985

§ 102(e) Date: Sep. 10, 1985

[87] PCT Pub. No.: WO85/02990

PCT Pub. Date: Jul. 18, 1985

[30] Foreign Application Priority Data

Jan. 10, 1984 [SE] Sweden ..... 8400091

[51] Int. Cl.[4] ..... A47K 3/02

[52] U.S. Cl. ..... 4/555; 4/590; 292/145

[58] Field of Search ..... 4/555, 590, 556; 292/137, 145, 147, DIG. 71; 220/140

[56] References Cited

U.S. PATENT DOCUMENTS

| | | | |
|---|---|---|---|
| 718,101 | 1/1903 | Decker | 292/DIG. 71 |
| 1,646,136 | 10/1927 | Booth | 292/145 |
| 2,075,933 | 4/1937 | Friedlander | 4/556 |
| 2,081,728 | 5/1937 | Bassett | 4/590 |
| 2,457,066 | 12/1948 | Pepersack | 220/140 |
| 3,240,523 | 3/1966 | Heimann | 292/DIG. 71 |
| 3,380,078 | 4/1968 | Hanson | 4/590 X |
| 3,423,769 | 1/1969 | Cowley | 4/590 X |
| 3,663,971 | 5/1972 | Bonhote | 4/590 X |
| 4,099,272 | 7/1978 | Sowder | 4/590 X |
| 4,100,628 | 7/1978 | Franzl | 4/579 |
| 4,360,935 | 11/1982 | Barrett | 4/555 |

FOREIGN PATENT DOCUMENTS

| | | | |
|---|---|---|---|
| 0109960 | 5/1984 | European Pat. Off. | 4/555 |
| 2313694 | 3/1974 | Fed. Rep. of Germany . | |
| 2613746 | 4/1975 | Fed. Rep. of Germany . | |
| 2032870 | 9/1977 | Fed. Rep. of Germany . | |
| 357492 | 7/1968 | Sweden . | |
| 361262 | 5/1972 | Sweden . | |
| 36372 | 3/1906 | Switzerland | 292/145 |
| 2085721A | 5/1982 | United Kingdom . | |

*Primary Examiner*—Charles E. Phillips

*Attorney, Agent, or Firm*—Cushman, Darby & Cushman

[57] ABSTRACT

Sitting bathtub constituted by a tub (10) provided with an opening (11) extending almost down to the bottom of the tub and a hatch (15) to close this opening. When closing the bathtub before having a bath the hatch (15) is placed on the inside of the bathtub and the hydrostatic forces of the water forces the hatch against the edges of the opening where a seal is provided on the hatch. The sides and in particular the side with the opening are inclined or sloped outwards from the bottom so that the hatch with its seal will rest by its own weight against the seal. In particular seal (16), hatch (15) and the side of the bathtub are so arranged that a good sealing effect is always certain at the bottom of the bathtub when the rising water and the resulting hydrostatic pressure enable the sealing effect to climb upwards even on a light and slightly flexible hatch. This in turn enables the hatch to be very light and easy to handle and it is thus no inconvenience to have a loose hatch. The hatch is suitably transparent or clear.

8 Claims, 7 Drawing Figures

SITTING BATHTUB

Figure 1A:
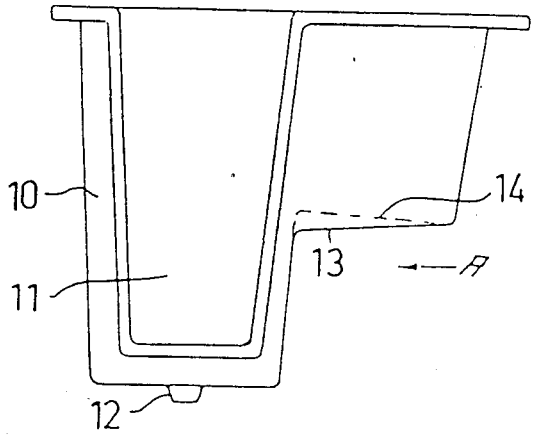

This invention is primarily intended to provide bath- and washing possibilities for persons who for different reasons (disabilities etc) now find it impossible to or only with extreme difficulty can use ordinary bathtubs.

To have a bath in a bathtub and to be entirely surrounded by warm water, to have the entire body warmed up is except the purely hygienic aspects of bathing of a major stimulance for many persons, in particular old people and those suffering from rheumatism etc.

According to literature bathtubs of different forms have been known already before classical antiquity. Tubs of wood or copper are among the forrunners of the bathtubs of today with outlet. In known embodiments the bathtubs can essentially be divided into reclining tubs (longer) and sitting bathtubs (shorter). The bathtubs can either be standing by themselves or be built in, stand on the bathroom floor or be sunk partly or entirely. Among the sitting bathtubs a version has existed called closettub, which was built into a closet.

Common to most of todays known bathtubs is a relatively big heigth for stepping in or out, about 0,5 meter or more and that the entire inside of the tub is sloping towards the outlet. The person in the bath, therefore, has a tendency to slide towards the lowest point (the outlet) of the tub. Furthermore, a normally sized adult in sitting position will have the upper part of his body, shoulder etc uncovered by water and is thus chilled by the air which is not a pleasant experience.

Sitting baths with a low entrance step for elderly and disabled persons exist in several different models. Common to the known embodiments are the more or less complicated devices that are necessary in order to seal the door of the tub. These complicated devices make the product expensive to purchase and dubious to use from a hygienic point of view. In those cases when a lift for patients is used the cost may be still higher. The above points are probably the main reasons why so few bathtubs for elderly and disable persons are in use at present.

The present invention defines solutions of the above problems and constitutes a sitting bath with low threshold and a seat inclined towards the rear, from the lowest point (outlet) thus giving a comfortable sitting position without the risk of sliding towards the outlet end of the bathtub. The water draining from the seat, inclined towards the rear, takes place via two chutes at the sides of the seat. By those chutes at the sides of the seat the advantages are obtained of a fullsized, entire seat with undivided sitting surface and, furthermore, the horizontal adjustment of the bathtub becomes uncritical. Furthermore, the relatively big depth of the tub enables a sitting, normally sized adult to be entirely surrounded by water up to the level of his neck/chin. This is particularly important for people who are elderly, rheumatics etc. The relatively big depth of the bathtub can however give a feeling of confinement. The loose hatch (see below) may therefore suitably be fabricated from a transparent material.

A side effect of the invention is that a footbath is obtained in the bottom part (at the outlet). Through the big entrance opening on one side of the bathtub a helper to the bathing person can take care of his/her footbath, in case the bathing person has difficulties in bending downwards. The footbath can suitably initiate the full bath, the first polluted water being let out. Then the bottom and the sides are showered clean before the full bath begins.

The sitting bath described below has as the baths of today an upper edging or frame that at the outside is turned downwards. The tub in accordance with the invention has however on one side a big opening extending almost to the bottom of the tub leaving only a low threshold. This opening is intended for the entrance of the bathing person.

A sitting bath according to the invention can as well as the bathtubs of today be fabricated in enamelled steel, reinforced or unreinforced plastics or other suitable materials.

The sitting bath in accordance with the invention can as is usual today be provided with feet, be supported in a frame (open box) or be supported in other suitable ways. Feet or corresponding means are provided with levelling means (for instance screws). The sitting bath in accordance with the invention is constituted by few simple parts and this renders the bathtub very hygienic, since it is very easy to clean the tub after finishing the bath. The design with few and simple parts, also, renders the sitting bath priceworthy which in turn enables it to be available to the public, which is essential.

Supports and gripping means can be fitted to the sitting bath in order to facilitate entrance and exit. A step or low foot-stool or similar means in front of the opening of the tub reduces the height of entrance to that of the threshold. These aids are of a great importance to persons physically impaired.

Further advantages and details are apparent from the following description of a preferred embodiment of the invention with reference to the drawings. In the drawings FIG. 1*a* shows the bathtub seen from one side and FIG. 1*b* a cross section of the tub, FIGS. 2*a* and 2*b* two views of a door or hatch of the tub, FIGS. 3*a* and 3*b* details of the sealing and FIG. 4*a* a tub with a supporting frame.

Figure 1B:
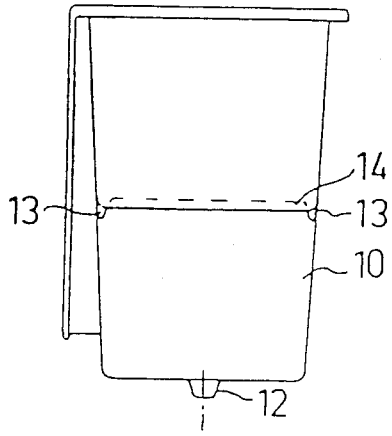
Figure 2A:
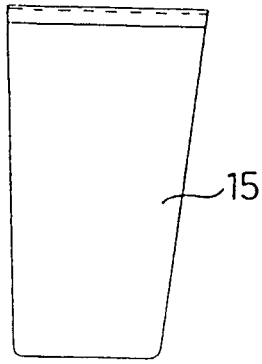
Figure 2B:
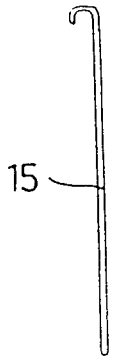

The sitting bathtub in accordance with the invention consists essentially of two major parts, the tub 10 shown in FIGS. 1*a* and 1*b* and the hatch 15 shown in FIGS. 2*a* and 2*b*. As is apparent from FIG. 1*b* the bathtub 10 has inwards towards the bottom inclined or sloping sides (walls) giving as is common practice with most bathtubs a greater cross- and length dimension at the top than at the bottom. One side of the bathtub (right, left or front) is provided with an opening 11 extending almost to the bottom of the bathtub. In the shown embodiment the opening 11 is on the left side. The purpose of this opening is to give a low threshold for anyone who enters the bathtub. The loose hatch 15 has dimensions larger than those of the opening of the bathtub. When closing the opening 11 with the hatch 15 this is placed on the inside of the bathtub covering the opening. In this position the hatch is hooked over the edge of the bathtub. Between the hatch and the inside of the bathtub an elastic seal 16 is placed. This seal 16 is fitted to the hatch. The seal is provided with a lip 20 resulting in a high specific surface pressure (good sealing function).

The side walls including that one with the opening are inclined. The hatch is hooked over the edge of the tub in such a way that the bottom part of the hatch is first supported. This will give the essential initial sealing effect at the lower part when water is first filled into the bathtub.

Further up it may well be at this stage a gap between the hatch and the side of the bathtub. The water will with increasing height in the tub successively push the hatch (and its seal) outwards thus giving a full sealing effect to the required level.

In this way several advantages are obtained. To start with, the pressure of the water exerted on the hatch 15 is transferred on to the seal as well as the pressure exerted directly on the seal secures that no water will leave the bathtub this way. Furthermore it becomes actually impossible to open or remove the hatch 15 as long as there is water in the bathtub and as a result there is no risk of inadvertent opening of the hatch resulting in a massive outflow of water which might result in apartment damages and which is perhaps more important in this case, also might negatively influence the balance of the person sitting in the bathtub by the outflowing water. In this way further security arrangements become unnecessary. Still the hatch can be made very light and it is thus of no inconvenience that it has to be lifted (a little bit) into its place. This can be done also by elderly weak persons.

Figure 3B:
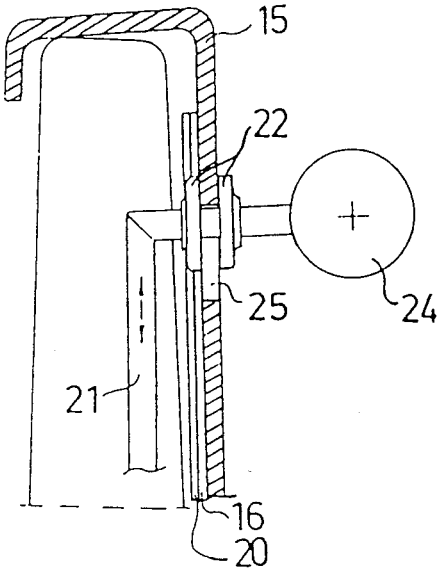
Figure 3A:
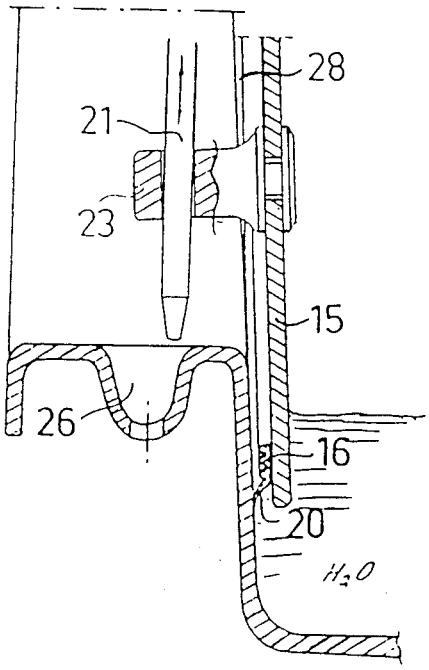
Figure 4:
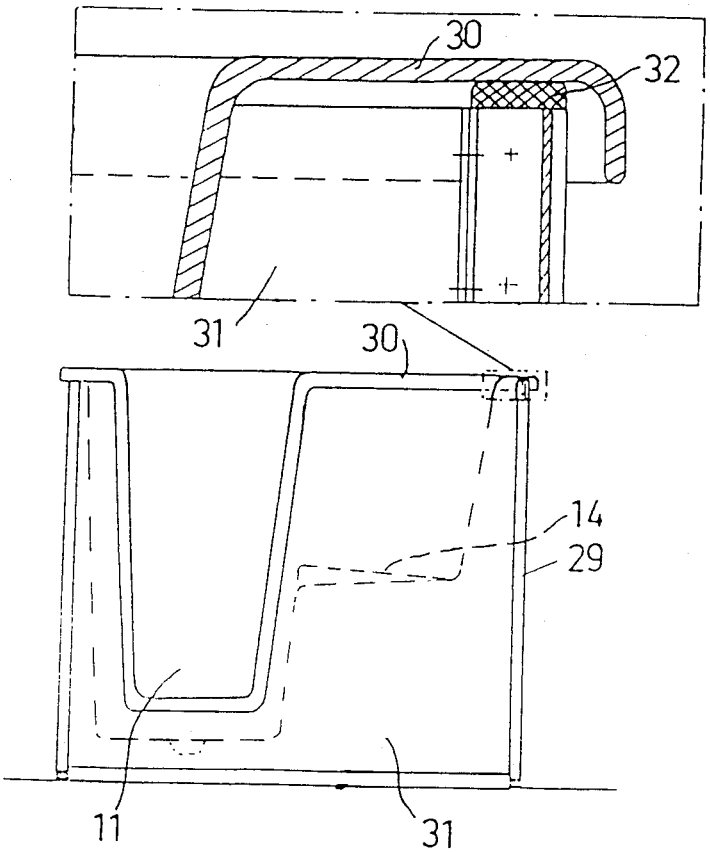

The inverted U-shape of the upper part of the hatch is so shaped that the hatch will hang over the edge of the bathtub with a certain play sideways. In this way it can be ascertained that the hatch with the seal is first in contact with the bottom part of the opening of the bathtub. In order further to secure this initial bottom sealing the hatch can be provided with a mechanical locking means. As is shown in FIGS. 3*a*, 3*b* this may comprise a rod 21 vertically movable in guides 22, 23. The rod is operated by a grip 24 extending through an elongated hole 25 high up in the hatch. The hole restricts the movement of the rod and also prevents the tub from being overfilled. When the hatch is lifted to its proper closing place it is lifted in the grip 24 and when the correct position is achieved the grip is pressed downwards gripping into a slot or recess 26 in the threshold. The recess and the end of the rod are so chamfered that latterally a movement and a force is exerted on the bottom of the hatch drawing this and its seal against the opening. This rod can of course also be used to centre the hatch relative to the opening. As the water then progressively fills the bathtub the pressure exerted by the water on the hatch 15 forces this successively outwards closing the wedge-like gap 28 to a sealing contact over the entire height of the hatch.

The seat 14 of the sitting bathtub is provided with an incline backwards towards the support for the back. In order to empty the tub and not to entrap the water at the rear of the seat chutes 13 are provided at the sides of the seat inclined forwards. The inclination or slope backwards gives a very comfortable sitting position without any risk for the sitting person to slide forward towards the lower part of the bathtub (at the outlet). The inclination of the chutes relative to the horizontal is opposite that of the seat. By arranging these drainage chutes 13 at the sides of the seat 14 the advantage of a comfortable whole seat surface and, furthermore, the horizontal adjustment of the bathtub become uncritical since drainage of all water is always secured. The whole seat in combination with the big depth of the tub also facilitates the washing of private parts.

The bathtub is fabricated with a relatively big depth of 80–100 cm, enabling the water to reach the neck/chin of the bathing person. The big depth can however give a feeling of confinement which can be counteracted very efficiently by making the hatch of transparent material of for instance "plexiglass" or similar resistant flexible synthetic resin materials.

The shown sitting bath can also be used as a footbath having the depth of 5–15 cm, that is the distance from the threshold to the bottom of the bathtub.

The sitting bathtub can be sunk into the floor levelling the floor with the bottom edge of the opening. This results in a negative step into and step out corresponding to the depth of the footbath.

The hatch in the shown embodiment is in the opened position hooked over the front short side of the tub. The person who intends to have a bath enters the bathtub, grips the hatch, lifts it slightly, turns and hooks the hatch over the edge at the opening. The grip and rod is pushed down so that the bottom part of the hatch including the seal rests against the inside of the tub giving the initial sealing. As the tub progressively is filled with water the sealing function continues upwards.

Of course bathtubs in accordance with the invention can be provided with bubble- and massagebath means where corresponding needs exist.

The tub can of course be supported in many different ways. One particularly advantageous way is however to support the tub at its corners for instance by a frame provided with legs 29 extending the upper edge 30 of the tub. The legs are on top provided with slightly protruding knobs 32 between frame and tub. The weight of the water in the tub has a tendency to push down the center of the tub and bring the legs inwards towards each other. However, the pressure exerted by the water on the sides of the bathtub has an opposite tendency to extend the opening and as a result these forces balance each other and in practice practically no movement can be observed for the sides of the opening. The legs 29 of the frame is held together by sides made in glasfiber reinforced plastic riveted to the legs.

The basic principle of the invention can also be used if the opening is increased to include almost one entire side of the bathtub. In a bathtub of this kind a person in a wheel-chair can rather easily be moved sidewards into the bathtub. A further alternative is that the opening is increased also to include a part of the bottom of the tub, in which way the threshold can be reduced to a minimum. The possibility of a footbath can then be provided by means of a low separate hatch.

In the above embodiment the essential initial sealing (enabling the water pressure to continue the sealing) is obtained by gravity forces exerted on the hatch aided by rod. Of course other simple means can also be used, but probably the use of an inclined side of the bathtub will prove itself to be the most suitable solution, in particular as bathtubs are preferably provided with inclined sides, primarily in order to facilitate their removal from the mould and secondly to facilitate storing of several bathtubs when they are transported, stored etc. However, further possibilities exist and another rather simple solution is to provide a jet suction pump in the water inlet of the bathtub, which pump is used to give a vacuum immediately when water is flushed into the bathtub. The vacuum is piped to the lower seal area provided with suitable suction chambers or channels and in this way the water entering the bathtub will give the suction force securing the seal. This method will work independent of inclined sidewalls as soon as the hatch is in contact with the side and water inlet starts.

The successive climbing of the sealing function is obtained in two different ways in the shown embodiment due to the shape of the seal. To start with the lip 20 of the seal 16 itself subjected to the water pressure capable of successively sealing the tub. Secondly also the rise of the water causes the hatch to fit outwards closing the wegdelike space between hatch and opening and forcing the seal 16 against the side of the opening.

In fact this progressive sealing is so automatic that also a very slight initial pressure at the bottom of the hatch will later on secure its entire sealing. As a consequence the locking rod and grip is more psychologically than functionally required. If malfunction of the seal occurs due to e.g. old age of the seal an extra sufficient pressure can easily be established with a foot or a knee.

It should further be mentioned that within the scope of the invention other simple means can be used to established the initial bottom sealing, for instance the use of memory metal triggered by the temperature of the water in the bottom of the tub. Other mechanical devices using manpower or other pressures can also be used. For instance the water pressure can act on a piston that causes a hook to draw the hatch towards the opening. Of course different magnetic devices can also be used e.g. the seal in itself can be magnetic.

What is claimed is:

1. A bathtub having a bottom and a surrounding side wall which together from an open-topped container having an upper edge, the side wall and upper edge having an opening through which a person may enter and leave the bathtub, a separate, manually maneuverable hatch which is free of connection to the bathtub so as to be selectively placed inside and outside the bathtub by the user, said hatch having an upper edge provided with an inverted U-shaped edge capable of hooking over and contacting the edge of the bathtub and allowing play toward and away from said side wall, said hatch having dimensions greater than the dimensions of said opening so that when placed inside the bathtub the edge portion of said hatch overlies the edge portion of said opening whereby said hatch covers said opening; a seal between the edge portion of said hatch and the edge portion of said opening, said hatch and bathtub being so shaped that upon mounting said hatch inside said bathtub in overlying relationship to said opening sufficient sealing contact is obtained initially at the lower edge of said opening to close a gap which exists between said edge portion of said opening and said seal so that water when entering the bathtub exerts further pressure on said hatch, which pressure successively extends upwards as the water rises in the bathtub thereby completing sealing of the edge portion of said hatch to the edge portion of said opening.

2. A bathtub as in claim 1 wherein said side wall at least at the location of said opening is inclined upwardly and outwardly from said bottom so that gravity force on said hatch effects initial sealing at the lower end of the hatch.

3. A bathtub as in claim 1 wherein said hatch is transparent.

4. A bathtub as in claim 1 wherein the upper edge of the hatch and the edge of the bathtub are so shaped that their contact point is at an outer portion of the edge of bathtub and at an outer portion of the upper edge of the hatch thus increasing the torque exerted by the weight of the hatch, thus in turn increasing the sealing pressure between bottom parts of the hatch and opening edges.

5. A bathtub as in claim 1 including a seat within said tub, said seat being inclined backwards and further including water draining chutes inclined forwards and placed sideways of the seat, said chutes extending from the back end of the seat to a deeper part of the bathtub for draining water from the seat area when the bathtub is emptied.

6. A bathtub as in claim 1 wherein the opening has a threshold and wherein the initial sealing at the lower edge of the opening is obtained by a vertical movable rod gripping into a slot or recess in the threshold, a rod and/or slot being provided with chamfered cooperating surfaces pulling the bottom of the hatch outwards when the rod is pushed downwards.

7. A bathtub as in claim 1 wherein said seal is a lip seal, the lip extending laterally out from the hatch so that the pressure of the water can press directly on the seal.

8. A bathtub having a bottom and a surrounding side wall which together form an open-topped container having an upper edge, the side wall and the upper edge having an opening through which a person may enter and leave the bathtub, a separate, manually maneuvrable hatch which is free of connection to the bathtub so as to be selectively placed inside and outside the bathtub by the user, said hatch having dimensions greater than the dimensions of said opening so that when placed inside the bathtub the edge portion of said hatch overlies the edge portion of said opening whereby said hatch covers said opening; a seal between the edge portion of said hatch and the edge portion of said opening, said hatch having an upper edge of generally inverted U-shape which can be hooked over the upper edge of said side wall at the location of said opening when said hatch is inside said bathtub to thereby support said hatch in a position opposite said opening whereby the pressure of water which has been added to said bathtub forces said hatch toward said side wall.

* * * * *